US006828998B2

(12) United States Patent
Sasaki

(10) Patent No.: US 6,828,998 B2
(45) Date of Patent: Dec. 7, 2004

(54) RECORDING METHOD AND RECORDING APPARATUS WITH INCLINED PLURAL BEAM ORIENTATION

(75) Inventor: Yoshiharu Sasaki, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/983,408

(22) Filed: Oct. 24, 2001

(65) Prior Publication Data

US 2002/0051051 A1 May 2, 2002

(30) Foreign Application Priority Data

Oct. 26, 2000 (JP) ..... P.2000-327217

(51) Int. Cl.[7] ..... B41J 2/435
(52) U.S. Cl. ..... 347/229
(58) Field of Search ..... 347/229, 234, 347/238, 248, 215, 216, 240; 430/201

(56) References Cited

U.S. PATENT DOCUMENTS 4,393,387 A * 7/1983 Kitamura ..... 347/240
5,321,426 A * 6/1994 Baek et al. ..... 347/240
5,534,383 A * 7/1996 Takahashi et al. ..... 430/201
5,831,659 A * 11/1998 Baek et al. ..... 347/238

FOREIGN PATENT DOCUMENTS

DE 26 53 539 * 6/1978 ..... G03F/5/00

* cited by examiner

*Primary Examiner*—Hai Pham
(74) *Attorney, Agent, or Firm*—Sughrue Mion, PLLC

(57) ABSTRACT

When desired images are recorded on an image receiving sheet 140 by laminating a toner layer of a transfer sheet 240 as heat-mode sensitive material and an image receiving layer of an image receiving sheet 140 to be fixed to a recording medium fixing member 310 and exposing the transfer sheet 240 of a recording medium while moving the recording medium fixing member 310 in a main scanning direction and also moving a plurality of aligned laser beam spots in a vertical scanning direction that is perpendicular to the main scanning direction, exposure is carried out by laser beam spots which are inclined such that a spot on an upstream end in the vertical scanning direction is positioned on a downstream side in the main scanning direction rather than a spot on a downstream end in the vertical scanning direction.

11 Claims, 5 Drawing Sheets

RECORDING METHOD AND RECORDING APPARATUS WITH INCLINED PLURAL BEAM ORIENTATION

BACKGROUND OF THE INVENTION

1. Field of the Invention

The present invention relates to a recording method and a recording apparatus for recording information such as images, characters, etc., especially, information such as color images, characters, etc. employing respective KCMY color toners on a recording medium.

2. Description of the Related Art

To record the image, the characters, etc., there is the recording method of fixing an image receiving sheet and a transfer sheet to overlap them and exposing them by the laser. In this case, the image receiving sheet is wrapped on a drum to direct an image receiving layer upward, and the transfer sheet is wrapped on the drum to overlap a toner layer with the image receiving layer. A recording head for executing the laser exposure is reciprocally moved in parallel with a rotation axis of the drum. A laser beam is emitted from the recording head and is irradiated as a plurality of spots. As shown in FIG. 6, a spot arrangement comprised of a plurality of the spots Ls' are aligned one-dimensionally along the moving direction of the recording head. In this recording method, the rotation direction of the drum is set as the main scanning direction, and the moving direction of the recording head is vertical to the main scanning direction so called a sub-scanning direction. Accordingly, if a rotational motion of the drum and a linear motion of the recording head are combined with each other, the spots can be scanned on the transfer sheet and thus desired images can be transferred onto the image receiving sheet.

In the above recording method, the optical energy of the laser beam is changed into the thermal energy by the photothermal conversion layer at the recording spot portion onto which the laser spot is irradiated.

The heat is generated in an instant, so that the moisture and the organic solvent contained in the photothermal conversion layer and the toner layer are volatilized to generate gas. For this reason, in the case of the above recording method in which the image receiving sheet and the transfer sheet are laminated and the action layer to react with the laser beam is put between two sheets, the generated gas is difficult to escape into the air and such gas remains between the image receiving sheet and the transfer sheet.

Concerning this condition from a microscopic point of view, the generated gas is easy to escape at both ends of the spot arrangement in the sub-scanning direction (the right side or the left side in FIG. 6). However, since the generated gas at the almost center portion of the spot arrangement is difficult to escape to said both ends, such gas still remains at the almost center portion of the spot arrangement of which characteristics can be further explained as follows.

In FIG. 6, as to the upper side of the spot arrangement, or the upstream side of the main scanning direction, the area can be regarded as a post recorded area where both a toner sheet and an image receiving sheet keep enough heat in-between so that the adhesive condition is still made, to which makes gas difficult to escape from each spot. On the other hand, the right side of the spot arrangement, or the upstream side of the sub-scanning direction, this area can be regarded as a pre-recorded area, by the main scanning being performed previously, where both temperature between a transfer sheet and an image receiving sheet is almost back to a normal with lowering the adhesive power which allows gas to escape in-between. Turning now to the left side of the spot arrangement, or the downstream side of the sub-scanning direction, this area can be regarded as an open ended space to which gas can always escape. Finally, as to the lower side of the spot arrangement, or the downstream side of the main scanning direction, since this area is not yet recorded, gas can escape.

Summarizing the above mentioned four-divided areas for the gas to escape, from both the distal end portions of the spot arrangement which is aligning along the sub-scanning direction, it is possible for gas to escape into the respective outside area, while it is difficult for the gas generated to be closer to the center spot of the spot arrangement to provide with such an escape area in the sub-scanning direction. Concerning this circumstance, most gas generated under the spot arrangement has no chance to escape to the sub-scanning direction, then it shows a tendency such as to escape to the downstream side of the main scanning direction, in other word, to the unrecorded area.

Now, turning to the main scanning speed, which is characterized of its speed being far faster than that of the sub-scanning speed, there arises a problem such that after the main scanning speed reaches the gas-escaping speed in the main scanning direction, laser irradiation is performed onto the toner sheet having the image receiving sheet underneath but gas remains in-between.

In other words, the generated gas enters into a space between the toner layer and the image receiving layer at the almost center portion of the spot arrangement where the toner layer and the image receiving layer are brought into the state that they are not tightly adhered to each other. In this state, the toner layer cannot be transferred onto the image receiving layer at the portion to which the laser beam is irradiated, so that the situation might be caused such that the portion of the final image is not colored or the color of the portion is dulled. If this situation is viewed macroscopically or visually checked, a stripe having a width of the spot arrangement (longitudinal stripe) 3 appears in the drum rotation direction, as shown in FIG. 6, and thus the image becomes defective.

For example, if the spot arrangement with 32 spots are arranged to have a distance of 10 $\mu$m (2540 dpi) between neighboring spots, the width of the spot arrangement is 230 $\mu$m. Also, if 256 spots are arranged to have a distance of 10 $\mu$m (2540 dpi) between neighboring spots, the width of the spot arrangement is 2560 $\mu$m (2.56 mm). If this width of the spot arrangement becomes wider, the gas at the center portion is more difficult to escape. If this is watched by visual check, such gas is ready to monitor as the uneven image.

Further, in the state that the gas stays in the almost center portion of the spot arrangement and thus the toner layer and the image receiving layer are not tightly adhered, the heat generated by the photothermal conversion layer of the transfer sheet is not ordinarily flown to the image receiving layer side, and thus the transfer sheet side is filled with the heat. Thus, the temperature of the photothermal conversion layer and the toner layer of the transfer sheet is increased to exceed the normal temperature. In this manner, when the temperature rises enough to decompose the photothermal conversion layer and the toner layer, the gas is generated much more, so that the photothermal conversion layer and the toner layer are melted and decomposed to cause the abnormal state. If such state is brought about, the concentration becomes lower in the center portion or the photothermal conversion layer that is not essentially to be transferred is transferred onto the image receiving layer, whereby the image becomes more seriously defective.

SUMMARY OF THE INVENTION

The present invention has been made in view of the above circumstances, and it is an object of the present invention to provide a recording method and a recording apparatus in which the gas generated in a recording spot portion never remains between a toner layer and an image receiving layer in a recorded area and to achieve prevention of the image defect depending on an spot arrangement.

In order to achieve the above object, a recording method in this invention enables a recording of a desired image on a recording medium, which is provided by laminating a toner layer of a transfer sheet as heat-mode sensitive material and an image receiving layer of an image receiving sheet, by exposing the recording medium while moving the recording medium in a main scanning direction and also moving a plurality of aligned laser beam spots in a sub-scanning direction that is perpendicular to the main scanning direction, and exposure is carried out by laser beam spots of which spotting direction is inclined such that a spot on an upstream end in the sub-scanning direction is positioned on a downstream side in the main scanning direction rather than a spot on a downstream end in the sub-scanning direction.

In this way, gas generated in the recording spot portions can escape not only toward the downstream side of the main scanning direction but also toward the downstream side in the sub-scanning direction during the periods of the gas being generated. As a result, such gas never remains between the toner layer and the image receiving layer in the recorded area so that the adhesiveness between the toner layer and the image receiving layer can be held properly, the image defect depending on the spot arrangement can be prevented, and the good image can be obtained.

According to further aspect of this invention, it comprises a recording medium fixing member for fixing a recording medium which laminates a toner layer of a transfer sheet as heat-mode sensitive material and an image receiving layer of an image receiving sheet, said recording medium fixing member being moved in a main scanning direction, and a recording head which is moved in a sub-scanning direction, that is perpendicular to the main scanning direction, while exposing a plurality of aligned laser beam spots onto the recording medium respectively in response to image information, laser beam spots are aligned to be inclined such that a spot on an upstream end in the sub-scanning direction is positioned on a downstream side in the main scanning direction rather than a spot on a downstream end in the sub-scanning direction.

According to this recording apparatus, the laser beam spots are aligned to be inclined such that the spot on the upstream end in the subs-canning direction is positioned on the downstream side in the main scanning direction rather than the spot on the downstream end in the sub-scanning direction. In such arrangement of the laser beam spots, if the rotational motion of the recording medium fixing member and the linear movement of the recording head are combined with each other, the gas generated in the recording spot portion can be fed subsequently to the downstream side of the sub-scanning direction with the movement of the recording head. That is, the gas generated in the recording spot portion can escape to the unrecorded area sequentially, and the residue of the gas between the toner layer and the image receiving layer in the recorded area can be prevented.

In the recording apparatus according to another aspect of this invention, an inclination angle of aligned spots is set to a range of 5° to 85° to a vertical scanning axis.

In this recording apparatus, since the inclination angle of the laser beam spots that are one-dimensionally aligned is set to the range of 5° to 85° to the vertical scanning axis, the action for feeding the gas generated at the recording spot portion to the downstream side of the sub-scanning direction can be obtained without fail. More particularly, if the inclination angle of the laser beam spots that are one-dimensionally aligned is set to the range of 0° to 5° to the vertical scanning axis, the sufficient feeding action cannot be attained because of the small inclination and thus the gas remained in the recorded area is present. Also, if the inclination angle of the laser beam spots that are one-dimensionally aligned is set to the range of 85° to 90°, the inclination is excessively large and the high speed recording employing a plurality of desired spots cannot be achieved. In contrast, if the inclination angle is set to the range of 5° to 85°, the good gas feeding action can be achieved and also the high speed recording can be achieved.

DESCRIPTION OF THE PREFERRED EMBODIMENTS

Preferred embodiments of a recording method and a recording apparatus according to the present invention will be explained with reference to the accompanying drawings hereunder.

Figure 1:
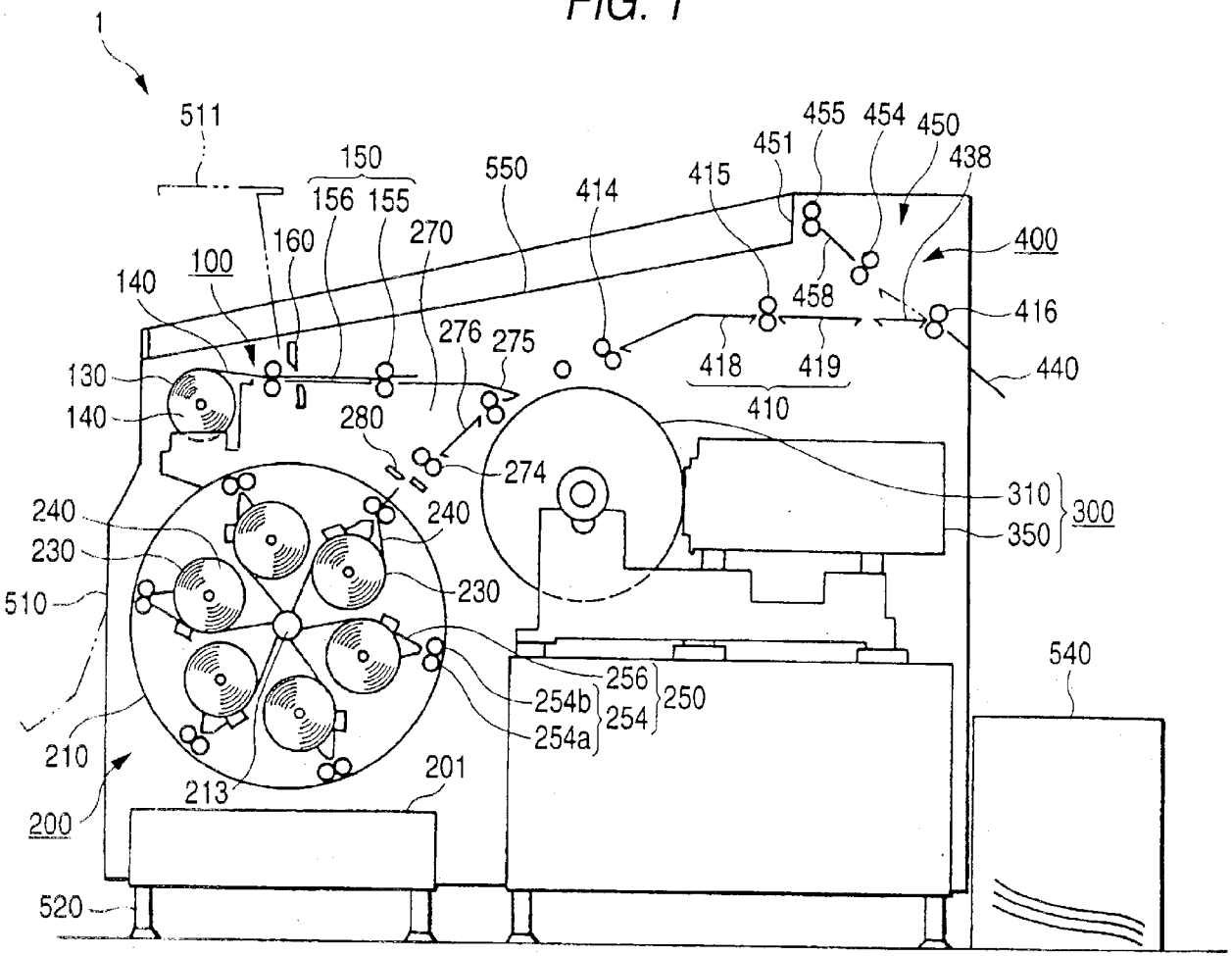
FIG. 1 shows an outline of a configuration of a recording apparatus according to the present invention.
Figure 2:
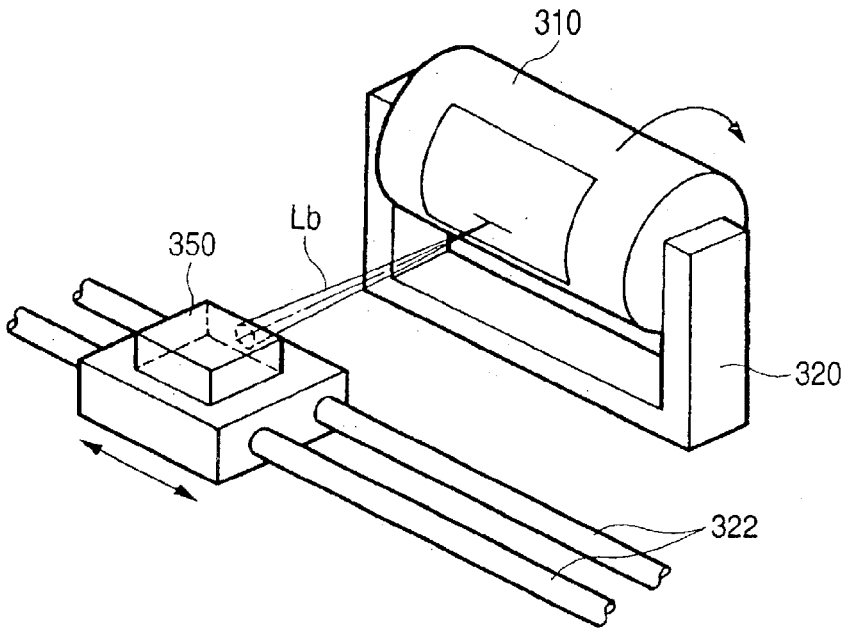
FIG. 2 shows an enlarged perspective view showing a recording portion.
Figure 3:
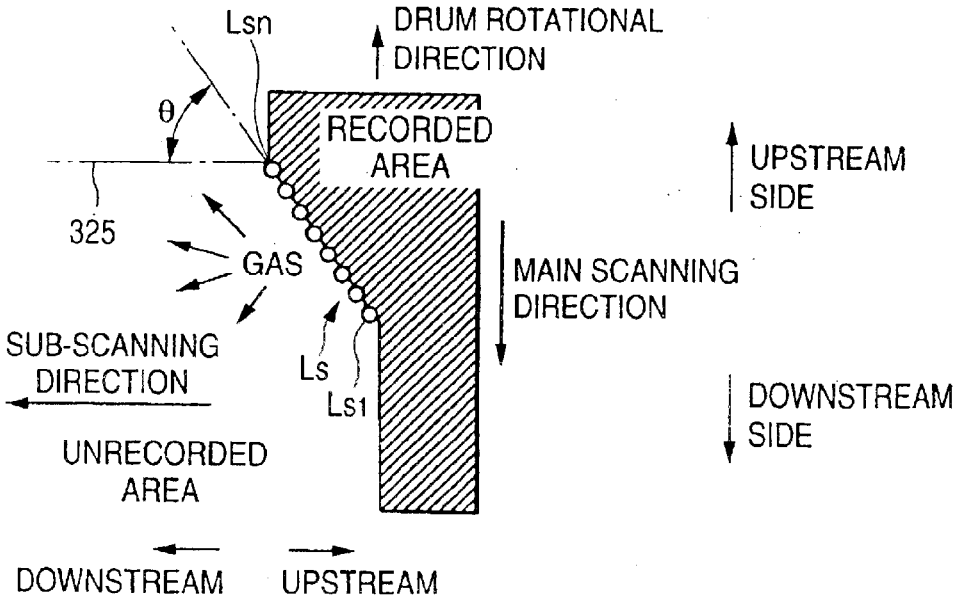
FIG. 3 shows a view illustrating the situation of the laser beam spot that is irradiated from a recording head.
Figure 4:
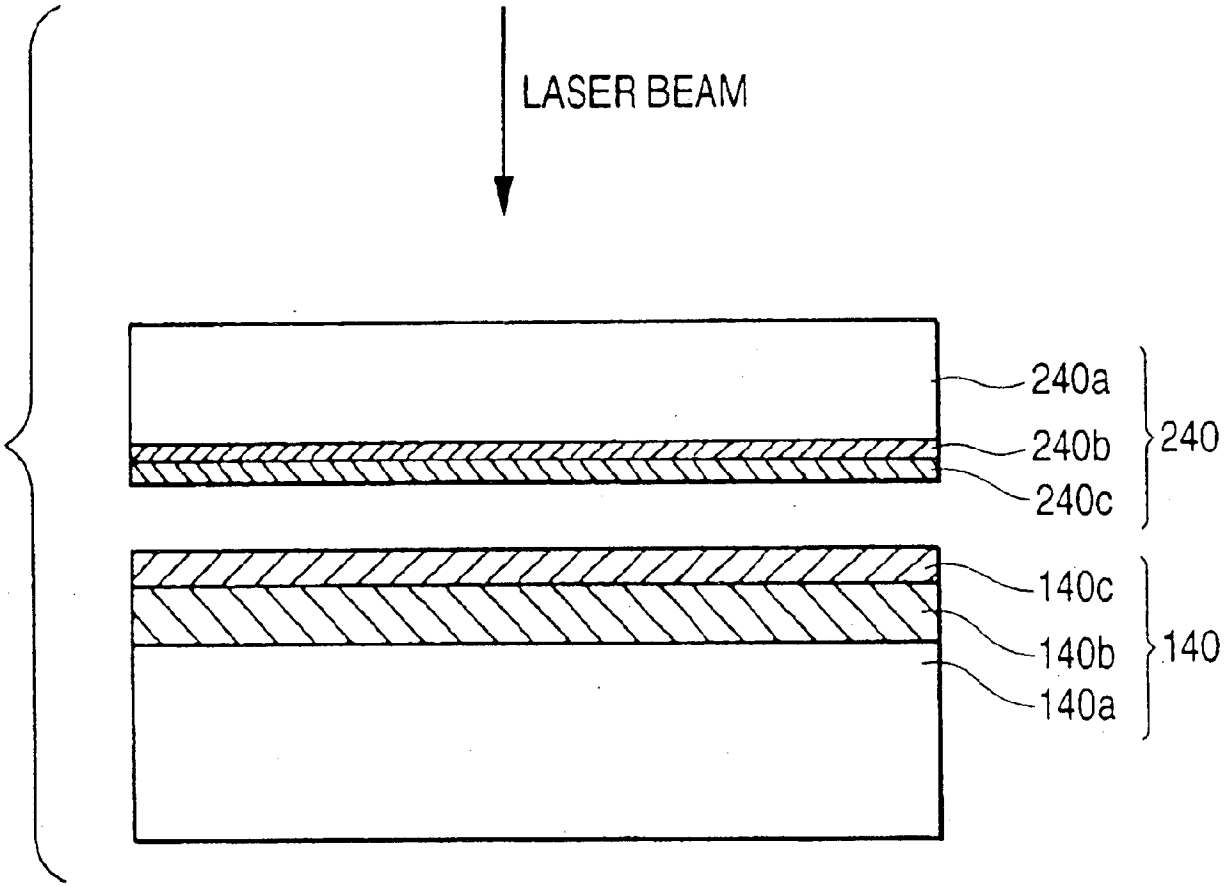
FIG. 4 shows a sectional view showing an image receiving sheet and a transfer sheet employed in a recording method and a recording apparatus according to the present invention.
Figure 5:
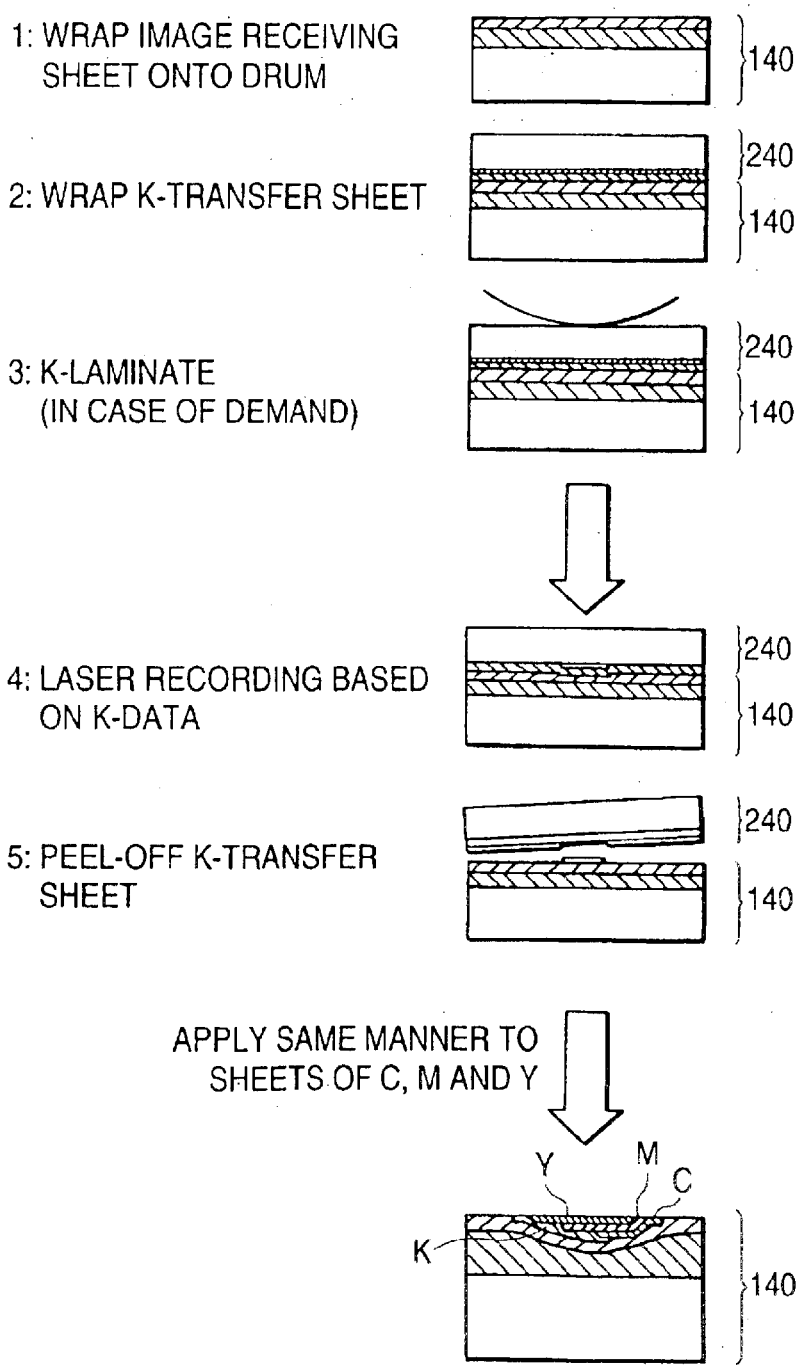
FIG. 5 shows a view showing schematically recording steps.
Figure 6:
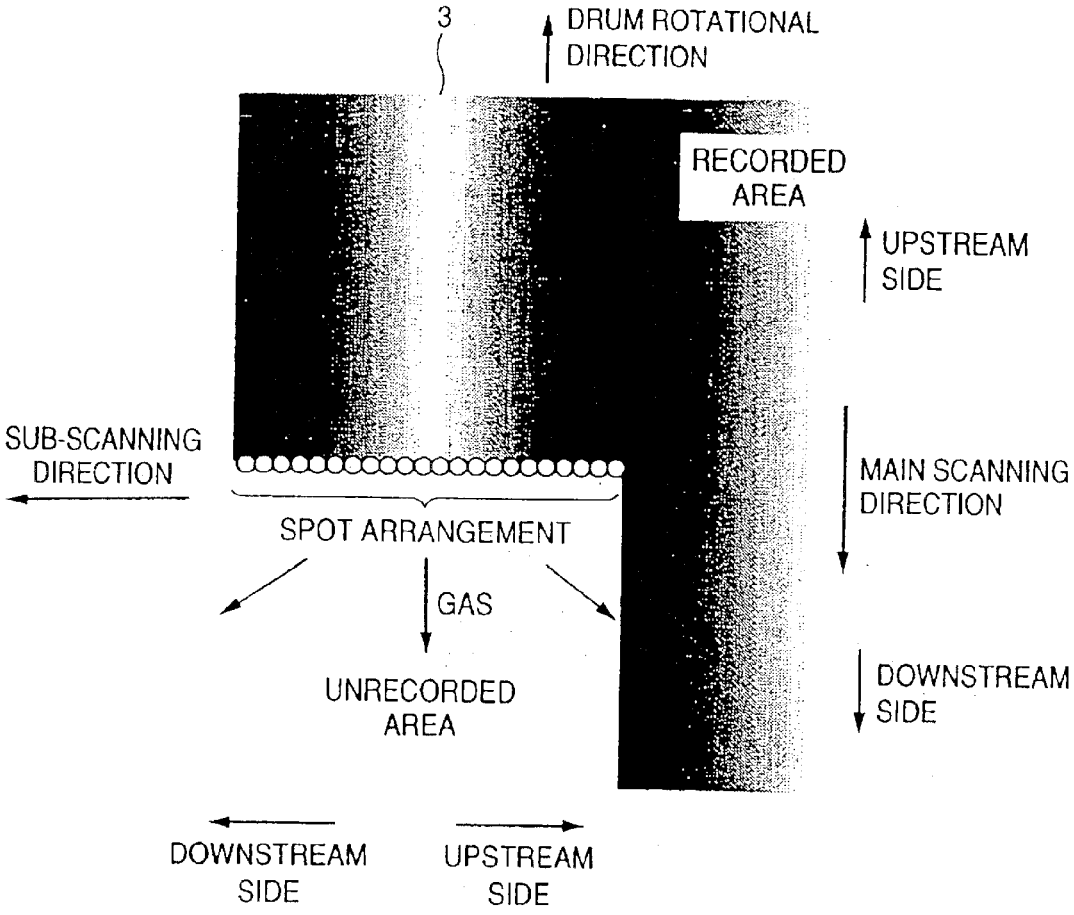
FIG. 6 PRIOR ART
FIG. 6 shows a view illustrating the situation of the laser beam spot that is irradiated by the recording method in the prior art.

FIG. 1 is a view showing an outline of a configuration of a recording apparatus according to the present invention. FIG. 2 is an enlarged perspective view of a recording portion. FIG. 3 is a view illustrating the situation of the laser beam spot that is irradiated from a recording head. FIG. 4 is a sectional view showing an image receiving sheet and a transfer sheet employed in the recording method and the recording apparatus according to the present invention. FIG. 5 is a view showing schematically recording steps.

As shown in FIG. 1, the recording apparatus 1 comprises an image receiving sheet supplying portion 100, a transfer sheet supplying portion 200, a recording portion 300, and a discharging portion 400. Also, a surface of the recording apparatus 1 is covered with a main body cover 510 and is supported by leg portions 520.

In the recording apparatus 1, the image receiving sheet supplying portion 100 supplies the image receiving sheet to the recording portion 300. Also, the transfer sheet supplying portion 200 can supply plural type transfer sheets, and can supply selectively one type transfer sheet among the plural type transfer sheets to the recording portion 300. In the recording portion 300, the transfer sheet is wrapped onto the image receiving sheet wounded on the drum 310, that serves as a recording medium fixing member, to overlap with it. Then, the laser exposure is applied to the transfer sheets superposed on the image receiving sheet based on the image information to be recorded. Since the toner on the portion, heated by the laser exposure, of the transfer sheet is adhered onto the image receiving sheet due to the degradation of the adhesive property, the melting, or the sublimation to be transferred onto it, the image is formed on the image receiving sheet. In addition, if the toners on the transfer sheets having plural different colors (for example, black, yellow, cyanogens, magenta) are adhered to the same image receiving sheet, the color image can be formed on the image receiving sheet. As described later, this can be achieved by the laser exposure executed after the exposed transfer sheet is exchanged into another color transfer sheet sequentially, while wrapping the image receiving sheet onto the drum 310 as it is.

The image receiving sheet on which this image is formed is discharged via the discharging portion 400, and then picked up from the present recording apparatus. Then, the image receiving sheet is heated/pressurized in a separately provided image transfer portion (not shown) in the situation that its surface on which the image is formed is overlapped on the recording sheet as the printing object. Accordingly, the toner is transferred onto any recording sheet (printing sheet) by which the image is formed.

The above is an outline of the recording apparatus 1.

Next, the image receiving sheet supplying portion 100, the transfer sheet supplying portion 200, the recording portion 300, and the discharging portion 400 will be explained in sequence respectively.

The image receiving sheet supplying portion 100 has an image receiving sheet roller 130. The image receiving sheet roller 130 is formed by wrapping an image receiving sheet 140 on its core. As shown in FIG. 4, the image receiving sheet 140 has a supporting layer 140*a*, a cushion layer 140*b*, and an image receiving layer 140*c*, and the cushion layer 140*b* and the image receiving layer 140*c* are laminated sequentially on the supporting layer 140*a*. PET (polyethylene terephthalate) base, TAC (tritylcellulose) base, PEN (polyethylene naphthalate) base, etc. may be employed as the supporting layer 140*a*. The image receiving layer 140*c* has an action to receive the transferred toner. The cushion layer 140*b* has an action to absorb the level difference caused when plural sheets of toners are laminated. In the image receiving sheet roller 130, the image receiving layer 140*c* is wrapped on the outside of the supporting layer 140*a* (the image receiving sheet roller wrapped in this manner is referred to as an "externally wrapped" image receiving sheet roller hereinafter). Also, the image receiving sheet roller 130 is provided such that it can be rotated around the center axis of the core.

The image receiving sheet supplying portion 100 has further an image receiving sheet carrying portion 150. The image receiving sheet carrying portion 150 comprises a motor (not shown), a drive transmitting belt or chain (not shown), carrying rollers 154, 155, a supporting guide 156, an image receiving sheet cutting portion 160, and a sensor (not shown) for sensing end points of the image receiving sheet.

The carrying rollers 154 and the carrying rollers 155 have a pair of rollers respectively. According to such driving mechanism, the image receiving sheet 140 can be sent out to the recording portion 300 or be returned from the recording portion 300.

First, the image receiving sheet 140 is pulled out by the above-mentioned driving mechanism such as the motor in the situation that a top end portion of the image receiving sheet roller 130 is put between the carrying rollers 154. Accordingly, the image receiving sheet roller 130 is turned and also the image receiving sheet 140 is fed out. The image receiving sheet 140 is sandwiched by the carrying rollers 155 and then guided by the supporting guide 156 to carry.

In this manner, the image receiving sheet 140 carried by the image receiving sheet carrying portion 150 is cut out by the image receiving sheet carrying portion 150 to have a predetermined length. A sensor is employed to measure the length. The length can be measured by sensing the top end of the image receiving sheet 140 by virtue of the sensor with regard to the rotation number of the motor, etc. The image receiving sheet 140 is cut at a predetermined length based on this measured result, and then supplied to the recording portion 300. The image receiving sheet cutting portion 160 has a cutter, a supporting portion, and a guide, although they are not shown. The carrying of the image receiving sheet 140 fed out from the image receiving sheet roller 130 by the above driving is stopped based on the measured result of the above image receiving sheet length, and then is cut by the cutter to have a predetermined length.

As described above, the image receiving sheet supplying portion 100 can supply the image receiving sheet 140 having a predetermined length to the recording portion 300 by feeding a part of the image receiving sheet roller 130 and then cutting the image receiving sheet.

Next, the transfer sheet supplying portion 200 will be explained hereunder.

The transfer sheet supplying portion 200 has a carrousel 210. As described later, this carrousel 210 is rotating axis 213. Also, a plurality of transfer sheet rollers 230 are installed in the carrousel 210 and are arranged in a "radial fashion" around the rotating axis 213.

Each transfer sheet roller 230 has a core, transfer sheets 240 wrapped on the core, and flanges (not shown) which are inserted from both sides of the core. Each transfer sheet roller 230 is held rotatably around the core. Since an outer diameter of the flanges is set larger than a diameter of the transfer sheet portion, collapse of such transfer sheet portion can be prevented.

As shown in FIG. 4, each transfer sheet 240 has a supporting layer 240*a*, a photothermal conversion layer 240*b*, and a toner layer 240*c*. The photothermal conversion layer 240*b* and the toner layer 240*c* are laminated in sequence on the supporting layer 240*a*. As the supporting layer 240*a*, any material may be selected from normal supporting materials (e.g., the same supporting material as the above supporting layer 140*a*) if they are laser-beam transparent material. The photothermal conversion layer 240*b* has an action to convert the laser energy into the heat. As the photothermal conversion layer 240*b*, any material may be selected from normal photothermal conversion materials if they are materials such as the carbon, the black substance, the infrared absorption pigment, the specific wavelength absorption material, etc., that can convert the optical energy into the thermal energy. As the toner layer 240*c*, respective toner sheets of black (K), cyanogens (C), magenta (M), and yellow (Y), for example, may be prepared.

In the transfer sheet roller 230, the toner layer 240*c* is wrapped on the outside of the supporting layer 240*a* (the transfer sheet roller wrapped in this manner is referred to as an "externally wrapped" transfer sheet roller hereinafter). As described later, the toner layer 240*c* has toner ink, and this toner ink is transferred onto the image receiving sheet by the laser exposure.

In FIG. 1, the case where six transfer sheet rollers 230 are installed in the carrousel 210 is shown. As this six type transfer sheets, for example, four color transfer sheets of black, cyanogens, magenta, yellow and special two color transfer sheets (for example, gold color, silver color, etc.) may be employed.

The carrousel 210 has transfer sheet feeding mechanisms 250 to respond to a plurality of transfer sheet rollers 230 respectively. The transfer sheet feeding mechanism 250 consists of a feed roller 254 and a supporting guide 256. In FIG. 1, six transfer sheet feeding mechanisms 250 are provided. The feed rollers 254 have a pair of rollers 254*a*, 254*b*. As described later, the roller 254*a* is connected to a motor by a gear mechanism and driven by the motor. The rollers 254*a*, 254*b* can put the transfer sheet 240 between them by a predetermined pressure. Then, the roller 254*b* rotates in the reverse direction to the roller 254*a* to carry the transfer sheet 240. The transfer sheet 240 can be held and fed out by the rollers 254*a*, 254*b* or can be returned oppositely by the rollers 254*a*, 254*b*. Also, the transfer sheet roller 230 is rotated according to the carry of the transfer sheet 240.

The transfer sheet 240 is supplied to the recording portion 300 by the transfer sheet feeding mechanisms 250 having such structure. The feed rollers 254 are driven by the above-mentioned driving mechanism such as the motor in the situation that a top end of the transfer sheet 240 is put between the feed rollers 254. The transfer sheet 240 is fed out by this driving. Also, the transfer sheet 240 is cut in a transfer sheet carrying portion 270, described later, to have a predetermined length and then supplied to the recording portion 300.

As described above, the carrousel 210 that installs a plurality of transfer sheet rollers 230 therein can supply selectively the desired type transfer sheet 240 to the transfer sheet carrying portion 270.

Also, the transfer sheet supplying portion 200 has the transfer sheet carrying portion 270. The transfer sheet carrying portion 270 comprises a motor (not shown), a drive transmitting belt or chain (not shown), carrying rollers 274, 275, a guide 276, a transfer sheet cutting portion 280, and a sensor (not shown) for sensing an end of the transfer sheet. The carrying rollers 274, 275 have a pair of rollers respectively. The rollers 274, 275 are connected to the motor via the drive transmitting belt or chain and driven by the motor to carry the transfer sheet 240.

According to such driving mechanism, the transfer sheet 240 can be fed out to the recording portion 300 or can be returned oppositely. Also, the transfer sheet 240 carried in this manner is cut by the transfer sheet cutting portion 280 to have a predetermined length. A sensor is utilized to measure the length of the transfer sheet 240. The length can be measured by sensing the end of the transfer sheet 240 by the sensor with regard to the revolution number of the motor, etc. The transfer sheet 240 is cut based on the measured result at a predetermined length and then supplied to the recording portion. Although not shown, the transfer sheet cutting portion 280 has a cutter, a supporting portion, a guide, etc.

As described above, the transfer sheet supplying portion 200 can supply the transfer sheet 240 having the predetermined length to the recording portion 300 by feeding out a part of the transfer sheet roller 230 and then cutting the transfer sheet.

When the transfer sheet 240 is exhausted, the used transfer sheet roller 230 must be detached and the transfer sheet 240 must be exchanged with the new transfer sheet 240.

The exchange of the transfer sheet roller 230 can be done by opening a lid 511. At this time, the transfer sheet roller 230 as the exchanged object is shifted previously to a predetermined exchanging position corresponding to the lid 511 by turning the carrousel 210. Also, the exchange of the image receiving sheet roller 130 is conducted by opening the lid 511.

Next, the recording portion 300 will be explained hereunder.

The recording portion 300 has a drum 310. As shown in FIG. 2, the drum 310 has a hollow cylindrical shape, and is held rotatably by a frame 320. In this recording apparatus 1, the rotational direction of the drum 310 is set as the main scanning direction. The drum 310 is coupled to a rotating axis of a motor and is rotated/driven by the motor. A plurality of hole portions are formed on a surface of the drum 310. These hole portions are connected to a sucking apparatus (not shown) such as a blower, a vacuum pump, etc.

If the above image receiving sheet 140 and the transfer sheet 240 are loaded on the drum 310 and then the sucking apparatus is operated, these sheets are sucked onto the drum 310.

Also, the drum 310 has a plurality of groove portions (not shown). The plurality of groove portions are provided on a straight line in parallel with the rotating axis of the drum 310. Also, a plurality of peeling claws (not shown) are provided over the drum 310 on a straight line in parallel with the rotating axis of the drum 310.

In addition, the recording portion has a recording head 350. The recording head 350 can emit the laser beam Lb. The toner ink on the transfer sheet 240 at the position to which the laser beam Lb is irradiated is transferred onto the surface of the image receiving sheet 140. Also, the recording head 350 can be moved linearly along a guide rail 322 by a driving mechanism (not shown) in the direction in parallel with the rotating axis of the drum 310. In this recording apparatus 1, this moving direction is set as the sub-scanning direction. Accordingly, the desired position on the transfer sheet for covering the image receiving sheet can be laser-exposed by a combination of the rotation motion of the drum 310 and the linear motion of the recording head 350. As a result, if only the corresponding position is laser-exposed based on the image information by scanning the transfer sheet by the laser beam serving as the drawing light beam, the desired image can be transferred onto the image receiving sheet 140.

Here the laser beam Lb that is irradiated from the recording head 350 will be explained in more detail.

The recording head 350 has light emitting elements (not shown) for irradiating the laser beam Lb or has light modulating elements for modulating the laser beam emitted from the light emitting element. Accordingly, if a plurality of light emitting elements are arranged at desired positions or modulating window portions of the light modulating elements are arranged at desired positions, the laser beam spot can have desired arrangements. Then, as shown in FIG. 3, the laser beam Lb emitted from the recording head 350 is irradiated onto the transfer sheet 240 as a plurality of laser beam spots Ls that are one-dimensionally aligned.

Then, this recording apparatus 1 has a feature of the laser beam spots Ls being included. That is, as shown in FIG. 3, the laser beam spots Ls are one-dimensionally aligned in such an inclination that the spot Lsl located on the upstream end in the sub-scanning direction takes a position of the main scanning direction on its downstream side, comparing to that of the spot Lsn located on the downstream end in the sub-scanning direction. Accordingly, in the recording situation shown in FIG. 3, an area located upper side of the laser beam sports Ls is a recorded area while an area located lower side of the laser beam spots Ls is an unrecorded area. Concerning the laser beam spots Ls under the level where it is divided into each beam spot, such as 1st, Ls2, . . . , and Lsn, an unrecorded area is provided at the left side of each beam spot, to which the generated gas can escape at the timing thereof. That is, as a whole to say, most generated gas can escape to the unrecorded area which is formed openly at the downstream end of the sub-scanning direction from the laser beam spots Ls. Further, concerning the effect of the scanning speed of the sub-scanning direction, as has been already explained, the speed is far below the speed of the main scanning so that the adverse effect of remaining gas is unlikely to happen. As to an inclination angleθ of the laser beam spots Ls that are one-dimensionally aligned, it is set to have a range of 50° to 85° to a vertical scanning axis 325.

Next, a wrapping operation of the image receiving sheet 140 and the transfer sheet 240 onto the drum 310 will be explained hereunder.

Two type sheets of the image receiving sheet 140 and the transfer sheet 240 are wrapped onto the drum 310. First, the image receiving sheet 140 supplied by the image receiving sheet supplying portion 100 is wrapped onto the drum 310. As described above, a plurality of hole portions (not shown) are formed on the surface of the drum 310 and the image receiving sheet 140 is sucked by the sucking apparatus (not shown). Therefore, the image receiving sheet 140 is wrapped on the drum 310 with the rotation of the drum 310 while being sucked by the drum 310.

Then, a sheet of transfer sheet 240 supplied from the transfer sheet supplying portion 200 is wrapped on the image receiving sheet 140. Two type sheets of the image receiving sheet 140 and the transfer sheet 240 have different sizes mutually, and the transfer sheet 240 is larger than the image receiving sheet 140 in both the longitudinal direction and the lateral direction. Accordingly, the portion of the transfer sheet 240 larger than the image receiving sheet 140 is sucked by the drum 310. The transfer sheet 240 is wrapped on the drum 310 with the rotation of the drum 310 while being sucked by the drum 310.

The image receiving sheet 140 and the transfer sheet 240 are wrapped onto the drum 310 such that the toner layer 240*c* of the transfer sheet 240 exists on the image receiving layer to come into contact with the image receiving layer 140*c* of the image receiving sheet 140. As described above, the toner ink of the toner layer 240*c* having such positional relationship is laser-exposed by the recording head 350 and is transferred onto the image receiving sheet 140. The transfer sheet 240 whose transferring operation is completed is released from the drum 310.

Next, this releasing operation will be explained hereunder.

First, the drum 310 is rotated up to a predetermined position. Then, the position of the top end portion of the above releasing claw is moved from the standby position, that does not come into contact with the drum 310, to the contact position, that comes into contact with the drum 310. The top end portion of the releasing claw is caused at this motion not to contact to the transfer sheet 240. The releasing claw is moved relatively over the drum 310 in the peripheral direction along the surface of the drum 310 with the rotation of the drum 310. The top end portion of the releasing claw is moved relatively on the surface of the drum along the shapes of the groove portions to slip into the lower side of the transfer sheet 240. The transfer sheet 240 is moved along an upper surface of the releasing claw. The transfer sheet 240 is released from the drum 310. Then, the releasing claw is lifted in the direction to go away from the drum 310 and moved to the standby position before it comes into contact with the image receiving sheet 140. After the top end portion of the transfer sheet 240 is released, the drum 310 is continued to rotate and thus the transfer sheet 240 is then released from the drum 310 and the image receiving sheet 140. At this time, since the image receiving sheet 140 is still sucked onto the drum 310 by a suction force of the sucking apparatus, only the transfer sheet 240 can be released.

Then, the transfer sheet 240 released by the above operation is discharged to the outside of the apparatus via a discharging portion 400 described later.

Then, another color transfer sheet 240 is wrapped onto the image receiving sheet 140, that is still wrapped on the drum 310, in the procedure described above. Then, according to the above operation, the toner ink of the transfer sheet 240 is transferred onto the image receiving sheet 140 by the laser exposure and then the transfer sheet 240 is released and discharged.

The similar operation is repeated for the transfer sheets 240 of predetermined plural types. For example, if the above operation is repeated for four transfer sheets 240 of black, cyanogen, magenta, and yellow, the color image can be transferred onto the image receiving sheet 140.

Finally, in this manner, the image receiving sheet 140 on which plural type toner inks are transferred is released. The release of the image receiving sheet 140 is conducted in the similar way to the release of the transfer sheets 240. At this time, the releasing claw comes close to a plurality of groove portions to release the image receiving sheet 140 from the drum 310. Also, since the same releasing claw as that used to release the transfer sheet 240 can be utilized, the configuration can be simplified. As a result, the reliability of the apparatus can be improved.

The image receiving sheet 140 released as above is discharged to the discharging portion 400.

Next, the discharging portion 400 will be explained hereunder.

The discharging portion 400 comprises a sheet common carrying portion 410, a transfer sheet discharging portion 440, and an image receiving sheet discharging portion 450.

The sheet common carrying portion 410 includes a motor (not shown), a drive transmitting belt or chain (not shown), carrying rollers 414, 415, 416, supporting guides 418, 419, and a sensor (not shown). Also, the sheet common carrying portion 410 has a mobile guiding portion which consists of a guide plate 438 and a driving mechanism (not shown). The guide plate 438 can be moved between two positions, described later, by the driving mechanism.

The transfer sheet discharging portion 440 is provided to discharge the processed transfer sheet 240 to the transfer sheet recovering box 540.

The image receiving sheet discharging portion 450 has an image receiving sheet discharging port 451, rollers 454, 455, and a guide 458. The image receiving sheet 140 on which the image is transferred is discharged onto a tray 550 via the image receiving sheet discharging portion 450.

Respective carrying rollers 414, 415, 416, 454, 455 are constructed by two rollers as a set in the similar way to the above carrying rollers. If the rollers are rotated while sandwiching the image receiving sheet 140 and the transfer sheet 240 between two rollers, these sheets can be carried.

The discharging portion 400 having such mechanism executes the discharge of the image receiving sheet 140 and the discharge of the transfer sheet 240 based on following operations.

First, the discharge of the transfer sheet 240 will be explained hereunder.

The transfer sheet 240 that is subjected to the laser exposure in the recording portion 300 and becomes useless is released from the drum 310 as mentioned above. While supported by the releasing claw, the supporting guides 418, 419, and the guide plate 438, the released transfer sheet 240 can be held and fed out by the carrying rollers 414, 415, 416 to carry.

Then, the discharge of the image receiving sheet 140 will be explained hereunder.

The image receiving sheet 140 is released from the drum 310, as described above, after the toner ink is transferred on the image receiving sheet 140 and processed in the recording portion 300. While supported by the releasing claw, the supporting guides 418, 419, and the guide plate 438, the released image receiving sheet 140 can be held and fed out by the carrying rollers 414, 415, 416 to carry.

The sheet common carrying portion 410 is common to the case where the transfer sheet 240 is discharged, and thus the configuration can be simplified rather than the case the carrying portions are provided to respective sheets. In this case, in the sheet common carrying portion 410, the transfer sheet 240 is carried to direct the toner layer to the lower side and the image receiving sheet 140 is carried to direct the image receiving layer to the upper side. As a result, even if the image receiving sheet 140 and the transfer sheet 240 are carried sequentially by utilizing the same carrying path, there is no chance that the image formed on the image receiving layer of the image receiving sheet 140 is contaminated.

The image receiving sheet 140 is carried by the carrying rollers 414, 415, 416 and is discharged to the outside of the apparatus. However, all the image receiving sheets 140 are not always discharged to the outside of the apparatus. In the situation that the rear end portion of the image receiving sheet 140 is located on the guide plate 438 and is held by the carrying rollers 416, the drive by the motor is stopped once, and then the image receiving sheet 140 is pulled back toward the image receiving sheet discharging port 451 by rotating the motor reversely. That is, the "switch-back" operation is performed. The drive stopping timing is decided by using the signal supplied from the sensor. The sensor detects that the rear end of the image receiving sheet 140 passes through the position of the sensor, and then stops the drive of the motor 412 at a point of time when the image receiving sheet 140 is carried to reach a predetermined position.

Here the predetermined position signifies such a position that the rear end of the image receiving sheet 140 is located on the guide plate 438 and held by the carrying rollers 416. It can be decided based on the number of the rotation pulses of the motor from a time point when the rear end is sensed by the sensor, whether or not the image receiving sheet 140 is moved by a predetermined distance to reach this position.

A guide blade 438 of the mobile guiding portion is driven by the driving mechanism (not shown) and can be moved between a broken line/a solid line shown in FIG. 18. The guide blade 438 is moved by this driving mechanism. Then, if the motor being stopped is rotated reversely, the carrying rollers 416, 454, 455, etc. are driven in the opposite direction. The image receiving sheet 140 is pulled back by this reverse rotation. Then, while supported by the guide 458, the image receiving sheet 140 is carried by the carrying rollers 454, 455 and fed out to the tray 550. As described above, the image receiving sheet being sent out to the tray 550 is taken out from the present recording apparatus, and then additional processes are executed in the separately provided image transferring portion. As a result, the image can be printed on any printing paper.

The above operations can be controlled by a controlling portion (not shown).

The controlling portion controls the image receiving sheet supplying portion 100, the transfer sheet supplying portion 200, the recording portion 300, the discharging portion 400, and others. The controlling portion controls the driving portions having the motors in above respective portions, and particularly controls the air portions such as the sucking device, etc. and the image processing portion for processing the image data in the recording portion 300. Also, the driving portion for the transfer sheet supplying portion 200 has two driving systems, i.e., a rotation driving system for the carrousel 210 and a sheet-carry driving system for providing the transfer sheet 240 from the transfer sheet roller 230 to the drum 310. As described above, as with the motor drive in the sheet-carry driving system out of them, the motor driving driver is commonly used in a plurality of transfer sheet feeding mechanism. Thus, the driving circuit system can be simplified.

According to the above recording apparatus, the desired color image can be formed on the image receiving sheet 140. Operation procedures in the case where the color image is formed by using four colors of black, cyanogen, magenta, yellow will be explained in the following.

As shown in FIG. 5, first, in step 1, the image receiving sheet supplying portion 100 supplies the image receiving sheet 140 to the drum 310. The image receiving sheet 140 is provided by feeding out a part of the externally wrapped image receiving sheet roller 130 and then cutting the image receiving sheet, and then wrapped on the drum 310.

Then, in step 2, the transfer sheet supplying portion 200 supplies the black transfer sheet 240 to the drum 310.

When the carrousel 210 of the transfer sheet supplying portion 200 is rotated, the black transfer sheet roller 230 is moved to the position opposing to the transfer sheet carrying portion 270. The transfer sheet 240 is provided by feeding out a part of the externally wrapped transfer sheet roller 230 and then cutting the transfer sheet, and then wrapped on the drum 310. At this time, the top end of the transfer sheet 240 fed out from the transfer sheet roller 230 is positioned near the cutter 280 on the outside of the carrousel 210. At this time, after the transfer sheet 240 is fed, the transfer sheet feeding mechanism 250 can store the top end portion of the transfer sheet roller 230 at the inner side than the outer peripheral portion of the carrousel 210 by causing the feed rollers 254 to drive in the reverse direction. However, the feed rollers 254 still hold the top end in this case.

Then, in step 3, the transfer sheet 240 is laminated by heating/pressurizing. This laminating step is omitted in some cases.

Then, in step 4, the image is transferred and output onto the image receiving sheet 140 based on the image data given previously. Here the given image data is color-separated into images for respective colors, and the laser exposure is performed based on the image data color-separated for respective colors. The recording head 350 irradiates the drawing light beam spots Ls to the transfer sheet 240 based on the image data for respective colors after the color separation. The toner ink of the transfer sheet 240 is transferred onto the image receiving sheet 140, and then the image is formed on the image receiving sheet 140.

Then, in step 5, only the (K) transfer sheet 240 is released from the drum 310. The transfer sheet 240 released from the drum 310 is discharged into a transfer sheet recovering box 540 via the discharging portion 400.

Then, it is decided whether or not the transfer of all color transfer sheets 240 is completed. Then, if another type transfer sheet 240 must be supplied, the processes in above steps 2 to 5 are repeated. That is, respective operations in steps 6 to 17 are repeated for the transfer sheets 240 of respective cyanogen, magenta, yellow colors. As a result, the toner inks KCMY of four color transfer sheets are transferred onto a sheet of image receiving sheet 140, and then the image is formed on the image receiving sheet 140.

When the above processes are ended, it is decided that the laser exposure for the final transfer sheet 240 is completed.

Then, the image receiving sheet 140 is released from the drum 310. The released image receiving sheet 140 is discharged into the tray 550 via the discharging portion 400 by the switch-back operation. As for the discharged image receiving sheet 140, the toner ink on the image receiving sheet 140 is further transferred onto any printing paper in the separately provided image transferring portion. Accordingly, the proofreading color printing is carried out.

Therefore, according to the above recording method, since the exposure is carried out by the laser beam spots Ls inclined as above, the gas generated in the recording spot portion can escape toward the downstream side in the sub-scanning direction, as shown in FIG. 3. In this manner, since the generated gas can escape to the unrecorded area, the gas never remains between the toner layer 240*c* and the image receiving layer 140*c* in the recorded area, the adhesiveness between the toner layer 240*c* and the image receiving layer 140*c* can be held, and the image defect depending on the spot arrangement can be prevented.

Also, since the inclination angle of the laser beam spots Ls that are one-dimensionally aligned is set to the range of 5° to 85° to the vertical scanning axis, the action for feeding the gas generated at the recording spot portion to the downstream side of the sub-scanning direction can be obtained without fail. More particularly, if the inclination angle of the laser beam spots Ls that are one-dimensionally aligned is set to the range of 0° to 5° to the vertical scanning axis, the sufficient feeding action cannot be attained because of the small inclination and thus the gas remained in the recorded area is present. Also, if the inclination angle of the laser beam spots Ls that are one-dimensionally aligned is set to the range of 85° to 90°, the inclination is excessively large and the high speed recording employing a plurality of desired spots cannot be achieved. In contrast, if the inclination angle is set to the range of 5° to 85°, the good gas feeding action can be achieved and also the high speed recording can be achieved.

In the above embodiments, the outer drum type recording medium fixing member is explained as an example. But the inner drum type in which the recording is carried out by fixing the recording medium onto the concavely curved surface or the inner surface of the cylinder and then irradiating the laser beam from the center of the curvature or the center of the cylinder may be employed. In addition, the fixing member is not limited to the drum, and the recording apparatus in which the recording is carried out by scanning the laser beam in the main scanning direction and carrying the recording medium in the sub-scanning direction by virtue of the carrying mechanism may be employed.

Further, in the above embodiments, the recording is carried out by the laser beam spots that are aligned one-dimensionally. Similarly the present invention may be applied to the laser beam spots that are aligned two-dimensionally.

As described above, according to the recording method of the present invention, the exposure is carried out by the laser beam spots which are inclined such that the spot on the upstream end in the sub-scanning direction is positioned on the downstream side in the main scanning direction rather than the spot on the downstream end in the sub-scanning direction. Therefore, the gas generated in the recording spot portion can escape toward the downstream side in the sub-scanning direction, and thus such gas never remains between the toner layer and the image receiving layer in the recorded area. As a result, the adhesiveness between the toner layer and the image receiving layer can be held, and the good image can be obtained by preventing the image defect depending on the spot arrangement.

According to the recording apparatus of the present invention, the laser beam spots are aligned to be inclined such that the spot on the upstream end in the sub-scanning direction is positioned on the downstream side in the main scanning direction rather than the spot on the downstream end in the sub-scanning direction. Therefore, if the rotational motion of the recording medium fixing member and the linear movement of the recording head are combined with each other, the gas generated in the recording spot portion is fed subsequently to the downstream side of the sub-scanning direction with the movement of the recording head to escape to the unrecorded area. As a result, the residue of the gas between the toner layer and the image receiving layer in the recorded area can be prevented.

What is claimed is:

1. A recording method for recording a desired image on a recording medium, which is provided by laminating a toner layer of a transfer sheet as heat-mode sensitive material and an image receiving layer of an image receiving sheet, said method comprising:

exposing the recording medium;

moving the recording medium parallel to the main scanning direction but in an opposite direction of the main scanning and also moving a plurality of aligned laser beam spots in a sub-scanning direction that is perpendicular to the main scanning direction while exposing the recording medium, wherein exposure is performed by the laser beam spots of which a spotting direction is inclined such that a first spot located on an upstream end in the sub-scanning direction takes a position of the main scanning direction on a downstream side thereof, compared to that of a second spot located on a downstream end in the sub-scanning direction.

2. A method according to claim 1, wherein an inclination angle of said laser beam spots is set in a range from 50° to 85° to the sub-scanning direction.

3. The method of claim 1, wherein the inclination angle of said laser beams is set in a range from 55 to 85 degrees to the sub-scanning direction.

4. The method of claim 1, wherein a speed of conveyance in the sub-scanning direction is slower than a speed of conveyance in the main scanning direction.

5. The method of claim 1, wherein during exposure, any area of the recording medium located to a downstream side of the aligned beam spots in the sub-scanning direction comprises a yet-to-be exposed area of the medium.

6. The method of claim 5, wherein during exposure and after commencement of a second exposure in the main scanning direction on the recording medium, the area of the recording medium located to the downstream side of the aligned beam spots in the sub-scanning direction comprises a yet-to-be exposed area.

7. A-recording apparatus comprising:

a recording medium fixing member for fixing a recording medium, which laminates a toner layer of a transfer sheet as heat-mode sensitive material and an image receiving layer of an image receiving sheet, said recording medium fixing member being moved parallel to the main scanning direction but in an opposite direction of the main scanning direction; and a recording head which is moved in a sub-scanning direction, being perpendicular to the main scanning direction, while exposing a plurality of aligned laser beam spots onto the recording medium respectively in response to image information;

wherein said laser beam spots are aligned to be inclined such that a first spot located on an upstream end in the sub-scanning direction takes a position of the main scanning direction on a downstream side thereof, comparing to that of a second spot located on a downstream end in the sub-scanning direction.

8. A recording apparatus according to claim 7, wherein an inclination angle of said laser beam spots is set in a range from 5° to 85° to the sub-scanning direction.

9. The apparatus of claim 7, wherein the inclination angle of said laser beams is set in a range from 55 to 85 degrees to the sub-scanning direction.

10. The apparatus of claim 7, wherein a speed of conveyance in the sub-scanning direction is slower than a speed of conveyance in the main scanning direction.

11. The apparatus of claim 7, wherein the recording head includes a plurality of light emitting elements arranged in a linear arrangement such that a first light emitting element located on the upstream end of the sub-scanning direction takes a position of the main scanning direction on the downstream side thereof, compared to that of a second light emitting element located on the downstream end in the sub-scanning direction.

* * * * *